US007059891B2

(12) United States Patent
Bury

(10) Patent No.: US 7,059,891 B2
(45) Date of Patent: Jun. 13, 2006

(54) ELECTRICAL CONNECTING AND FASTENING APPARATUS

(75) Inventor: Joachim Bury, Detmold (DE)

(73) Assignee: Weidmüller Interface GmbH & Co. KG, Detmold (DE)

( * ) Notice: Subject to any disclaimer, the term of this patent is extended or adjusted under 35 U.S.C. 154(b) by 0 days.

(21) Appl. No.: 11/186,088

(22) Filed: Jul. 21, 2005

(65) Prior Publication Data

US 2006/0030202 A1 Feb. 9, 2006

(30) Foreign Application Priority Data

Aug. 4, 2004 (DE) ..... 20 2004 012 151 U

(51) Int. Cl.
*H01R 13/58* (2006.01)

(52) U.S. Cl. ..... 439/461; 439/426

(58) Field of Classification Search ..... 439/461, 439/426, 427, 394, 660, 658
See application file for complete search history.

(56) References Cited

U.S. PATENT DOCUMENTS

| | | | | |
|---|---|---|---|---|
| 2,892,992 | A * | 6/1959 | Grovemiller et al. | 439/619 |
| 3,176,652 | A * | 4/1965 | Mott et al. | 399/276 |
| 3,725,847 | A * | 4/1973 | Guneratne | 439/460 |
| 3,861,778 | A * | 1/1975 | Capra | 439/461 |
| 4,342,496 | A * | 8/1982 | Hutter et al. | 439/578 |
| 4,688,873 | A * | 8/1987 | Bowden et al. | 439/462 |
| 4,764,124 | A * | 8/1988 | Simon | 439/391 |
| 5,314,349 | A * | 5/1994 | Czeschka et al. | 439/394 |
| 5,567,174 | A * | 10/1996 | Ericson et al. | 439/462 |
| 5,763,833 | A * | 6/1998 | Bawa et al. | 174/65 SS |
| 5,899,769 | A * | 5/1999 | Konetschny et al. | 439/394 |
| 6,179,646 | B1 * | 1/2001 | Horchler | 439/460 |
| 6,902,437 | B1 * | 6/2005 | Wang | 439/668 |

FOREIGN PATENT DOCUMENTS

| | | |
|---|---|---|
| DE | 297 09 747 U1 | 10/1997 |
| DE | 299 09 822 U1 | 9/1999 |
| DE | 100 54 560 A1 | 5/2002 |
| DE | 102 03 288 A1 | 8/2003 |
| DE | 102 44 962 B3 | 6/2004 |

* cited by examiner

*Primary Examiner*—P. Austin Bradley
*Assistant Examiner*—Larisa Tsukerman
(74) *Attorney, Agent, or Firm*—Lawrence E. Laubscher, Sr.; Lawrence E. Laubscher, Jr.

(57) ABSTRACT

An electrical connecting and fastening apparatus includes a guide arrangement for respectively connecting a plurality of conductors of a hollow cable with a plurality of stationary contacts mounted in circumferentially spaced relation within a bore contained in one end of a cylindrical socket member, the guide arrangement being so operable that as the cable is progressively inserted into the socket member bore, the leading end of the cable is rotated and twisted about its longitudinal axis relative to the remaining portion of the cable and to the socket member, thereby to effect positive electrical engagement between the conductors and the stationary contacts, respectively. In a first embodiment, the conductors are insulated, and the contacts are of the insulation piercing type. In another embodiment, the conductors are bare, and the stationary contacts are resilient and are biased toward engagement with the conductors. A lock nut arrangement serves to lock the cable to the socket member.

19 Claims, 1 Drawing Sheet

ELECTRICAL CONNECTING AND FASTENING APPARATUS

BACKGROUND OF THE INVENTION

1. Field of the Invention

An electrical connecting and fastening apparatus includes a guide arrangement for respectively connecting a plurality of conductors of a hollow cable with a plurality of stationary contacts mounted in circumferentially spaced relation within a bore contained in one end of a cylindrical socket member, the guide arrangement being so operable that as the cable is progressively inserted into the socket member bore, the leading end portion of the cable is rotated and twisted about its longitudinal axis relative to the remaining portion of the cable and to the socket member, thereby to effect positive electrical engagement between the respective conductors and the stationary contacts. In a first embodiment, the conductors are insulated, and the contacts include insulation piercing means. In another embodiment, the conductors are bare, and the stationary contacts are resilient and are biased toward engagement with the respective conductors. A lock nut arrangement serves to lock the cable to the socket member.

2. Description of the Related Art

As has become known in the prior art, the wiring of electrical devices is often relatively laborious and therefore time-consuming and cost-intensive. For example, in the field of automation technology for buildings and the like, electrical devices are often connected with each other by means of a high type of protection (IP 65) and more, often with plug connectors by way of the so-called M5, M8 or M12 standard that have proved to be technically effective but often to be relatively expensive. This applies especially when the ready-at-hand prefabricated cables are not precisely in keeping with the intended purpose, so that special adaptations have to be made on the spot during installation. In other words, the conductive lines have to be shortened or lengthened and, in the process, one must assemble conductors that are provided with connector plugs or connector sockets.

Against this background, the present invention was developed to provide a linkup and connection device, which, in a simple manner, will facilitate reliable connection between a plurality of conductors with a plurality of associated stationary contacts.

BRIEF SUMMARY OF THE INVENTION

Accordingly, a primary object of the present invention is to provide a coupling and fastening arrangement for connecting the helically arranged conductors of a hollow cable with corresponding stationary contacts arranged within the bore of a cylindrical socket member, characterized by the provision of guide means that are operable during the axial insertion of the cable within the socket bore for rotating and twisting the leading end of the cable about its longitudinal axis relative to the remainder of the cable, thereby to effect positive electrical connection between the conductors and the respective stationary contacts.

According to another object of the invention, locking mans are provided for locking the cable to the socket member after the leading cable end has been rotated to its twisted condition, thereby to maintain positive electrical engagement between the cable conductors and the stationary contacts mounted in the socket bore. Preferably, a lock nut is threadably connected with the socket to axially compress an annular seal, thereby to cause radial inward deformation of the seal into tight engagement with the outer insulation layer of the cable.

A more specific object of the invention is to provide helical guide rib and slot means that are formed on the adjacent surfaces on the inner circumference of a hollow core member upon which the conductors are mounted in a space helical fashion, and on the outer circumference of a cylindrical guide projection that extends upwardly from the bottom wall of the socket bore into the cable leading end. During the progressive insertion of the leading cable end into the socket bore, the guide rib on the inner circumference of the cable core member engages a corresponding helical groove contained in the outer circumference of the projection, thereby to produce the desired twisting of the leading cable end. Preferably, the guide rib and guide slot have corresponding code profiling cross-sectional configurations, thereby to assure proper matching of the cables with the socket members.

According to the invention, the linkup and connection device for electrical devices features at least the following: a connecting cable with a high profile hollow core, which, along its inside circumference and/or its outside circumference, is provided with a code profiling element that is guided along the inside circumference of the profile core in spiral or screw fashion and which, furthermore, has at least one or several conductors guided in helical fashion along its outer circumference; and a socket member containing a socket bore into which the free end of the cable is inserted and which again has several resilient and/or insulation piercing cutting contacts for the purpose of contacting at least one conductor or several conductors on the outside circumference of the profile core member. The core member a is preferably equipped with a guide projection for the purpose of pushing the profile hose on as well as with a corresponding code profiling for the purpose of code profiling the cable on the socket member, in particular, on the socket member or on the guide projection.

Preferably, the guide projection is provided on its outer circumference with a corresponding code profiling for the purpose of code profiling the profile core so that upon insertion into the socket with the performance of a twisting screwlike motion, the connecting cable will be guided to contact the bottom of the socket bore.

According to an important advantage of the present invention, one-half of the hitherto necessary plug and socket members can be eliminated, because it is now possible directly to contact the free ends of the coded connecting lines or cables only with one socket part. In particular, it is possible entirely to dispense with M5, M8 or M12 plug and socket parts. Electrical equipment will now be provided with a novel kind of socket for this purpose. Connecting cables can be processed in several ready-to-use lengths, and preferably even "off the drum" applications; in this case, the cables need only to be cut to length and stripped. For this purpose, in particular, the structure of automation technology systems, and especially the connectors of distributors with each other as well as the linkup of appliances such as actuators, sensors and the like to the distributors, will definitely be accelerated and simplified.

Preferably, the code profiling of the profile core member extends radially inwardly in the manner of a rib, and the code profiling of the guide projection extends in the manner of a guide groove contained in the outer circumference of the guide projection. In a practical manner, the profile core member furthermore is provided along its outer circumference with several spaced-apart grooves, which extend in the axial direction in the form of a helical spiral or screw on the outer surface of the profile core member, into which grooves are introduced in each case one of the conductors. In particular, in the case of this design, it is very easily possible to forget about the attachment of plug parts upon the connecting line and to contact said line directly with a socket part. Good flexibility of the connecting device can be implemented by means of the spiral-like arrangement of the conductors and the coding devices. The spiral-like profiling furthermore directs the conductors particularly well to the contacts, in particular, toward the resilient cutting contacts. If the outer profiling is not uniformly distributed along the circumference, then a coding function can be performed with it if, during the insertion into the socket whereby it engages a corresponding inside coding means on the socket.

The socket member can either be attached to or formed on an electrical appliance such as a distributor, or with an additional free end of a connecting line, or on a coupling with two socket parts, for example, to extend a connecting line. Preferably, however, a connection is established directly between two socket parts, for example, adjoining electrical appliances directly with a connecting line with its two free ends.

Furthermore, the conductors are formed with a rectangular cross-section in the fashion of a band and/or they consist of a plurality of metal core leads and/or a preferably expansible and/or flattenable metal braiding in order to increase the flexibility of the line.

The contacts are made as insulation cutting contacts, in particular, resilient insulation piercing contacts, whereby the guide projection is used as a thrust bearing for supporting the conductors during the piercing of the insulation. In this way, one can come up with a simple and particularly reliable contacting technique. As an alternative, it is also conceivable that the contacts would be made as resilient contacts for engagement with bare conductors.

BRIEF DESCRIPTION OF THE DRAWINGS

Other objects and advantages of the invention will become apparent from a study of the following specification when viewed in the light of the accompanying drawings, in which.

DETAILED DESCRIPTION OF THE INVENTION

Figure 1:
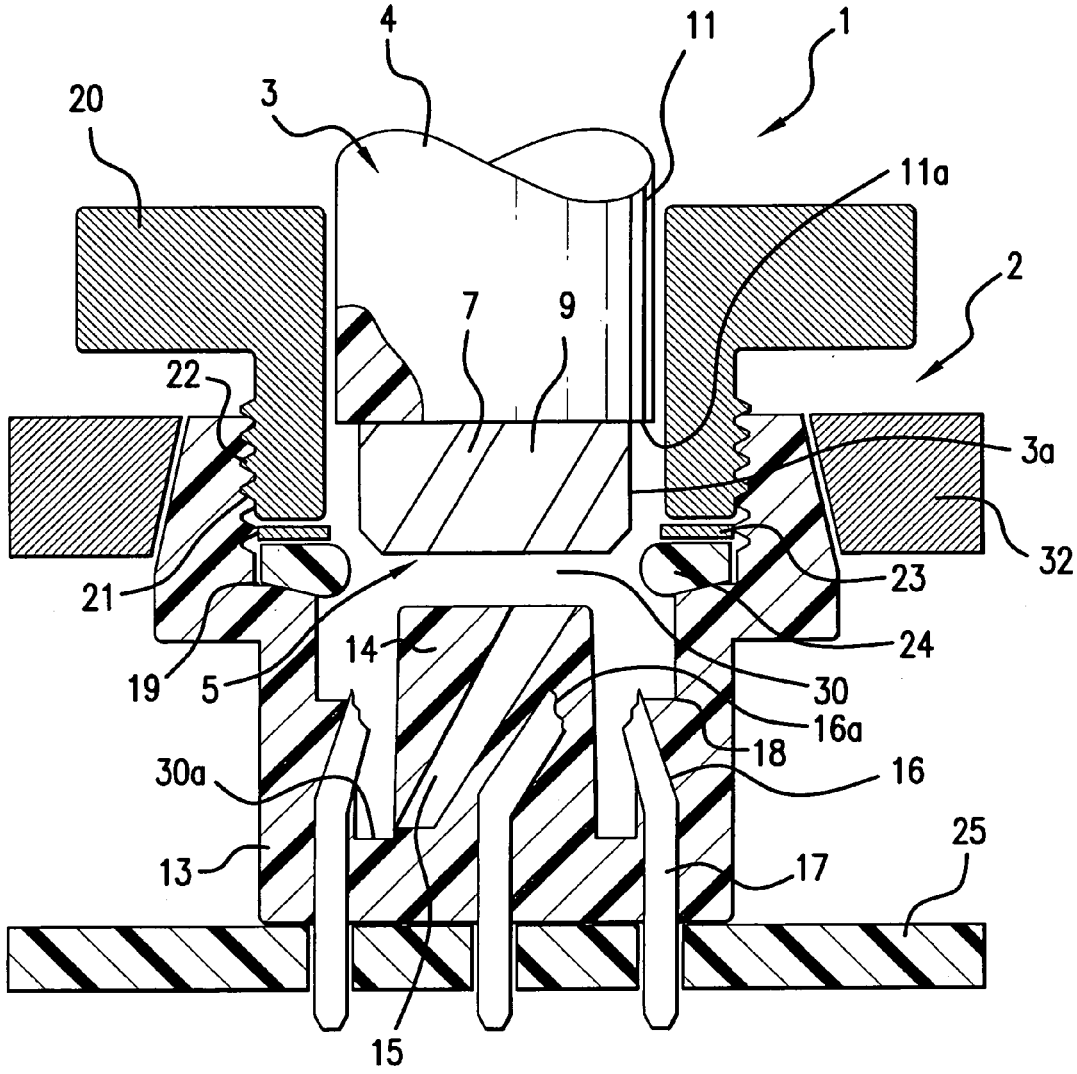
FIG. 1 is a detailed longitudinal sectional view illustrating the connecting and fastening means of the present invention.
Figure 2:
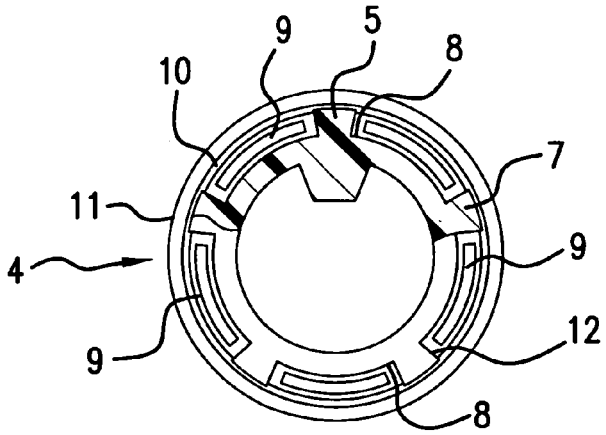
FIG. 2 is a bottom plan view of the insulated cable member of FIG. 1.

Referring first more particularly to FIG. 1, the connecting and fastening apparatus 1 of the present invention includes a cylindrical vertically arranged socket member 2 the upper end of which contains a bore 30 having a bottom wall 30*a*. Extending downwardly into the bore 30 is the leading one end 3 of a hollow electrical cable 4 that includes a tubular core member 5 formed of a suitable insulating synthetic plastic material. On its inner circumferential surface, the core member 5 is provided with a helical guide rib 6 having a tapered cross-sectional configuration that converges radially inwardly, as best shown in FIG. 2. On its outer circumferential surface, the core member 5 is provide with helical ribs arranged between helical grooves 8 that receive helical electrical conductors 9, respectively. Shown in FIG. 2, the conductors 9 have a flat cross-sectional configuration. The conductors are either in the form of flat bands, or as a braid formed from a plurality of small conductive wires, which braid is flattened to have the flat spiral configuration shown FIGS. 1 and 2. The spaces between the conductors and the walls of the groves 8 are filled with a foam filler material 10, such as polystyrene, thereby to stabilize the conductors 9 in the groves 8. A tubular layer of insulating material 11 is mounted concentrically about the core member 7.

Centrally arranged within the socket member bore 30 is an upwardly projecting integral guide portion 14 having an outer diameter that corresponds with, and is slightly smaller than, the inner diameter of the core member 5. The outer peripherial surface of the guide projection 14 is provided with a helical groove 15 that extends downwardly for receiving the guide projection 6. Mounted within the socket bore 30 are a plurality of circumferentially spaced electrical contacts 16 the lower ends of which comprise soldering pins 17 that extend downwardly through corresponding openings contained in the printed circuit board 25 upon which the socket member 13 is mounted. The contacts 16 are resilient and are provided at their upper extremities with insulation-piercing tip portions 16*a*.

In operation, when the leading cable end 3 is inserted downwardly in the bore 30, groove 15 receives the guide rib 6, whereupon as the cable 4 is further displaced downwardly in the socket bore 30, the cooperation between the rib 6 and the grove 15 causes the cable leading end 3 to rotate about its longitudinal axis, and to be twisted relative to the remaining portion of the cable. During this downward rotational twisting movement of the cable end 3, the insulation piercing tips 16*a* of the stationary contacts 16 penetrate the insulation layer 11 and the foam layer 10, thereby to effect positive direct engagement of the contacts with the associated electrical conductors 9. During this downward movement of the cable, the guide projection 14 extends within the tubular core member 5 and serves as a thrust bearing for supporting the same during the penetration of the insulation by the insulation-piercing extremities 16*a* of the resilient contacts, respectively. The cable continues to be inserted downwardly until the lower extremity of the core member 5 engages the bottom wall 30*a* of the bore 30.

In accordance with another embodiment of the invention, important feature of the invention, the socket bore 30 is provided with a first counter bore that defines an annular support surface 18 adjacent the tips of the contact 16. A length of the insulation layer 11 at the lower extremity 3*a* of the cable end 3 is stripped from the cable, thereby defining an insulation end wall surface 11*a* that is adapted to come into abutting engagement with the first counter bore step portion 18. In this case, the conductors of the end extremity 3*a* are exposed and bare, and the upper contact ends are resiliently biased into direct electrical contact with the exposed flat conductors 9.

According to another important feature of the invention, the socket member 13 includes a second counterbore that defines a second angular support surface 19. Mounted on this second support surface is an annular compressible resilient seal member 24. A lock nut 20 having a knurled outer peripherial surface is threadably connected by screw threads 21 and 22 with the upper wall portion of the second counter bore formed in the socket member 13. An annular washer 23 is arranged between the lock nut 20 and the annular seal 24, Thus, upon rotation of the locking nut 20, the nut is displaced downwardly to engage the washer member 23 and to axially compress the annular seal member 24, causing the inner portion of the seal to be deformed radially inwardly toward locking engagement with the outer peripheral surface of the insulation layer 11 of the cable 4. A rigid support ring 32 extends around the second counterbored portion of the socket member 13, thereby to support the upper portion of the socket during this tightening operation of the lock nut 20 and the accompanying compression and deformation of the seal 24.

According to a further feature of the invention, owing to the distinctive code profiling provided by the guide rib 6 and the corresponding guide groove 15, matching of the cables with the corresponding sockets is assured.

Other types of socket fastening means may be provided, such bayonet-type locks, plug latches or other types of screw-thread connections. Preferably, the guide projection 14 extends upwardly a substantial distance within the second counterbore defined at the upper end of the socket member.

As indicated above, the code profiling between the guide rib 6 and the guide grove 15 assures only the connection of the appropriate cable 4 with the associated socket member 13.

While in accordance with the provisions of the Patent Statutes the preferred forms and embodiments of the invention have been illustrated and described, it will be apparent to those skilled in the art that various changes may be made without deviating from the inventive concepts set forth above.

What is claimed is:

1. Electrical connecting and fastening apparatus for connecting the conductors of a cable with the contacts of a socket member, comprising:

(a) a hollow cable (4), including:

(1) a vertically arranged tubular core member (5) formed from a synthetic plastic electrical insulating material and having inner and outer circumferential surfaces, said core outer circumferential surface containing a plurality of circumferentially spaced helical conductor grooves (8); and (2) a plurality of helical electrical conductors (9) arranged in said grooves, respectively;

(b) socket means, including:

(1) a vertically arranged cylindrical socket member (13) formed from a synthetic plastic electrical insulating material and having an upper first end containing a downwardly extending bore (30) having a bottom wall (30*a*), and a cylindrical side wall (30*b*) having a diameter that corresponds generally with the outer diameter of said core member, thereby to permit axial insertion of said core member within said socket member bore; and (2) a plurality of stationary electrical contacts (16) arranged in circumferentially spaced relation within and adjacent the side wall of said socket bore; and (c) guide means operable upon progressive axial insertion of said cable within said socket member bore for rotating and twisting the leading end (3) of said cable about its longitudinal axis and for effecting positive electrical engagement between said conductors and said stationary contacts, respectively, said guide means including:

(1) a cylindrical guide projection (14) extending axially upwardly from said bore bottom wall, said guide projection having an outer circumferential side wall in concentrically spaced relation relative to said bore side wall, the diameter of said projection circumferential surface corresponding generally with and being slightly less than the inner diameter of said core member; and (2) guide rib and slot means (6; 15) arranged between the adjacent circumferential surfaces of said guide projection and said core member.

2. Electrical connecting and fastening apparatus as defined in claim 1, wherein guide rib and slot means are helical; and further wherein said helical conductor grooves, said helical conductors, and said helical guide means have the same pitch and orientation, respectively.

3. Electrical connecting and fastening apparatus as defined in claim 1, wherein said electrical conductors are insulated; and further wherein said stationary contacts include insulation piercing means.

4. Electrical connecting and fastening apparatus as defined in claim 1, wherein said electrical conductors are bare; and further wherein sad stationary contacts are resilient and are biased toward engagement with said bare conductors, respectively.

5. Electrical connecting and fastening apparatus as defined in claim 1, wherein said guide and slot means include a helical guide rib (6) provided on the inner circumferential surface of said core member, and a helical guide slot (15) contained in the outer surface of said guide projection.

6. Electrical connecting and fastening apparatus as defined in claim 5, wherein said guide rib (6) has a tapered convergent cross-sectional configuration.

7. Electrical connecting and fastening apparatus as defined in claim 1, wherein helical said conductor grooves are randomly arranged.

8. Electrical connecting and fastening apparatus as defined in claim 1, wherein each of said conductors has a rectangular cross-sectional configuration.

9. Electrical connecting and fastening apparatus as defined in claim 8, wherein each conductor comprises a solid conductor.

10. Electrical connecting and fastening apparatus as defined in claim 8, wherein each conductor comprises a plurality of wires formed into a braid, said wire braided being flattened to have a rectangular cross-sectional configuration.

11. Electrical connecting and fastening apparatus as defined in claim 1, wherein said guide projection is centrally arranged within said socket member bore and has a tapered upwardly convergent cross-sectional configuration, whereby when said cable leading end is in its fully inserted position within said socket bore, said core member and said conductors are expanded outwardly into positive engagement with said stationary contacts.

12. Electrical connecting and fastening apparatus as defined in claim 1, wherein the end surface of said core member leading end engages said socket member bottom wall when said cable leading end is in its completely inserted position within said socket member bore.

13. Electrical connecting and fastening apparatus as defined in claim 12, wherein the spaces in said conductor grooves around said conductors are filled with a foam filler (10), and further including a tubular layer of insulating material (11) arranged concentrically about said core member.

14. Electrical connecting and fastening apparatus as defined in claim 13, wherein said socket upper end contains a first counterbore defining an annular first bottom step surface (18), the diameter of said first counterbore corresponding with the outer diameter of said insulation layer; and further wherein an end portion of said insulation layer is stripped from an end extremity (3*a*) of said cable leading end, thereby to define on said insulation layer an end surface (11*a*) that engages said first bottom step surface when said cable leading end is fully inserted within said socket member bore.

15. Electrical connecting and fastening apparatus as defined in claim 14, and further including auxilary locking means (20, 21, 22) for locking said cable to said socket member.

16. Electrical connecting and fastening apparatus as defined in claim 15, wherein said socket member upper end contains a second counterbore defining a second annular bottom step surface (19); and further wherein said auxiliary locking means includes an annular compressible seal (24) mounted on said second annular bottom step surface, and an annular lock nut (20) extending into said second counterbore and threadably connected with the side wall surface thereof, said lock nut being operable to compress said seal radially inwardly into sealed engagement with the outer circumferential surface of said cable.

17. Electrical connecting and fastening apparatus as defined in claim 16, wherein said locking nut has a knurled outer circumferential surface; and further including a flat annular washer (23) arranged between said seal and said locking nut.

18. Electrical connecting and fastening means as defined in claim 17, and further including a rigid annular support member (32) arranged concentrically about the second counterbored upper end portion of said socket member.

19. Electrical connecting and fastening means as defined in claim 1, wherein said guide rib and slot means have corresponding code profile cross-sectional configurations, thereby to assure proper matching of the cables with the sockets, respectively.

* * * * *